US008033853B2

(12) United States Patent
Chang

(10) Patent No.: US 8,033,853 B2
(45) Date of Patent: Oct. 11, 2011

(54) ELECTRONIC DEVICE HAVING USB INTERFACE CAPABLE OF EXTRACTION PROOF

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/711,048

(22) Filed: Feb. 23, 2010

(65) Prior Publication Data

US 2010/0291783 A1 Nov. 18, 2010

(30) Foreign Application Priority Data

May 15, 2009 (TW) ..... 98208454 U

(51) Int. Cl.
*H01R 13/62* (2006.01)

(52) U.S. Cl. ..... 439/304

(58) Field of Classification Search ..... 439/304, 439/676, 358, 357, 352, 923
See application file for complete search history.

(56) References Cited

U.S. PATENT DOCUMENTS 6,619,976 B2 * 9/2003 Huetter et al. ..... 439/352
6,902,432 B2 * 6/2005 Morikawa et al. ..... 439/607.41
7,094,099 B2 * 8/2006 Daggett et al. ..... 439/567
7,128,595 B2 * 10/2006 Boutros ..... 439/358
7,160,137 B1 * 1/2007 Yeh ..... 439/358
7,465,181 B1 * 12/2008 Bridges et al. ..... 439/358
7,578,690 B2 * 8/2009 Caveney et al. ..... 439/344
7,578,691 B2 * 8/2009 Weksler et al. ..... 439/347
7,581,417 B1 * 9/2009 Chen ..... 70/57
7,632,125 B2 * 12/2009 Irwin et al. ..... 439/304
7,814,634 B2 * 10/2010 Francis et al. ..... 29/426.5
2003/0224637 A1 * 12/2003 Ling ..... 439/133
2005/0202698 A1 * 9/2005 Miao ..... 439/133
2006/0134962 A1 * 6/2006 Yeh ..... 439/352
2007/0099504 A1 * 5/2007 Wu ..... 439/607
2010/0317215 A1 * 12/2010 Chang ..... 439/305

FOREIGN PATENT DOCUMENTS

TW I273161 B 2/2007

* cited by examiner

*Primary Examiner* — Jean Duverne
(74) *Attorney, Agent, or Firm* — Chun-Ming Shih; HDLS IPR Services

(57) ABSTRACT

An electronic device, which has a USB interface capable of extraction proof, includes a main body and a USB metallic plug. One side of the main body has a USB metallic plug, on a face of which at least one fastening component is arranged. When the fastening component is buckled into the groove of a USB connector of an electronic product, it can prevent the electronic from being stolen by a thief.

5 Claims, 8 Drawing Sheets

ELECTRONIC DEVICE HAVING USB INTERFACE CAPABLE OF EXTRACTION PROOF

BACKGROUND OF THE INVENTION

1. Field of the Invention

The present invention in general relates to a connection interface, in particular, to a connection interface capable of anti-extracted by a thief at will.

2. Description of Prior Art

Universal Series Bus or so-called USB is a serial bus standard connecting external device. Because of the biggest merit of supporting hot plugging and "plug-and-play", USB is comprehensively used in computer today. When a device is plugged in, computer mainframe will load driving software needed by this device, which is more convenient than using PCI and ISA serial bus.

Since of USB connector, USB plug of portable electronic device can be quickly plugged in and used simultaneously. But, there is no mechanism existing between the USB connector and the USB plug of the portable electronic device for preventing the extraction. Therefore, as long as the USB plug of the portable electronic device is still plugged in the USB connector, the portable electronic device in connection with the USB connector is easily extracted and stolen, when user leaves the computer.

Accordingly, as disclosed in ROC Patent No. I273161 and entitled "Locking Structure of USB Connector", a locking structure with password is additionally arranged on the USB connector. This kind of prior art can prevent a portable electronic device from being stolen by a thief. Although the USB connector of a desktop computer can be additionally arranged a password locking structure, not all USB connector of desktop computer is arranged password lock. Therefore, when the USB plug of the portable electronic device is plugged in a USB connector without any password lock, there is still a risk that the portable electronic could be stolen by a thief.

SUMMARY OF THE INVENTION

Therefore, in order to solve aforementioned problems, the invention is mainly to provide a USB metallic plug additionally arranged an anti-extraction structure to a portable electronic device, such that the USB metallic plug can be fastened to all USB connector without the risk that the external device is stolen by a thief.

Secondly, the invention is to provide a USB interface capable of extraction proof to an electronic device. The electronic device can be plugged in a USB connector arranged to an electronic product and having at least one groove, including:

a main body, to one side of which a USB metallic plug is connected, on a face of which at least one fastening component is arranged.

It is characterized that when the fastening component is buckled into the groove of the USB connector of the electronic product, it can prevent the electronic product from being stolen by a thief.

BRIEF DESCRIPTION OF DRAWING

The features of the invention believed to be novel are set forth with particularity in the appended claims. The invention itself, however, may be best understood by reference to the following detailed description, which describes a number of embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, not used to limit its executing scope. Any equivalent variation and modification made according to appended claims is all covered by the claims claimed by the present invention.

Figure 1:
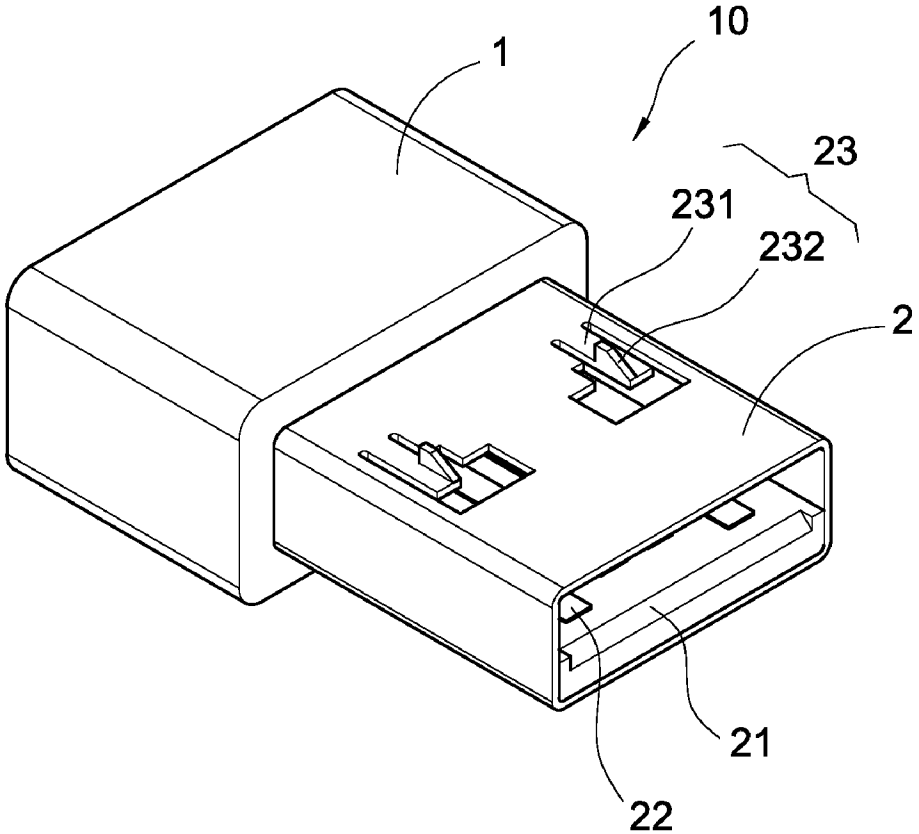
FIG. 1 is an illustration showing an electronic device having USB interface according to the present invention.

Please refer to FIG. 1, showing an illustration of an electronic device having USB interface according to the present invention. As shown in this figure, the electronic device 10 having USB interface capable of extraction proof according to the present invention includes a main body 1 and a USB metallic plug 2. The main body 1 can be a transmission line, a USB flash drive, a 3.5" hard disk, a wireless transceiver module, a wireless bridge or a wireless network bridge. One side of the main body 1 has a USB metallic plug 2 arranged thereon. The inside of the USB metallic plug 2 is hollow and arranged a tongue 21, on which a plurality of conductive legs 22 are arranged, one side of each of which is extended into the main body 1 and electrically connected to the circuit (not shown in the figures) and the wire (not shown in the figures) in the main body 1. Additionally, at least one fastening component 23 is arranged on a face of the USB metallic plug 2 and has two elastic bodies 231, each side of each of which is arranged a barb part 232.

Figure 2:
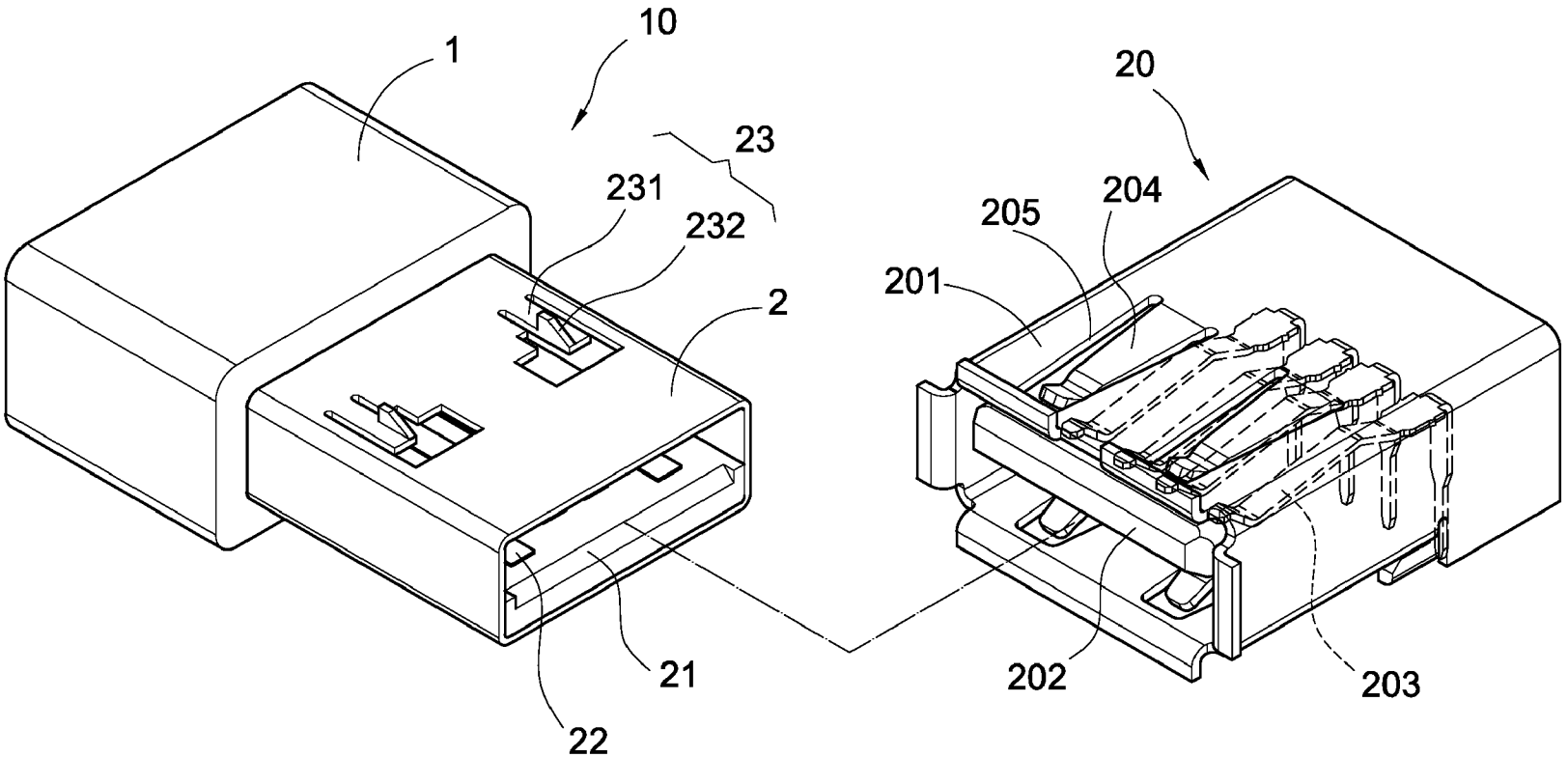
FIG. 2 is an outer perspective illustration showing an electronic device having USB interface according to the present invention plugged in a USB connector.
Figure 3:
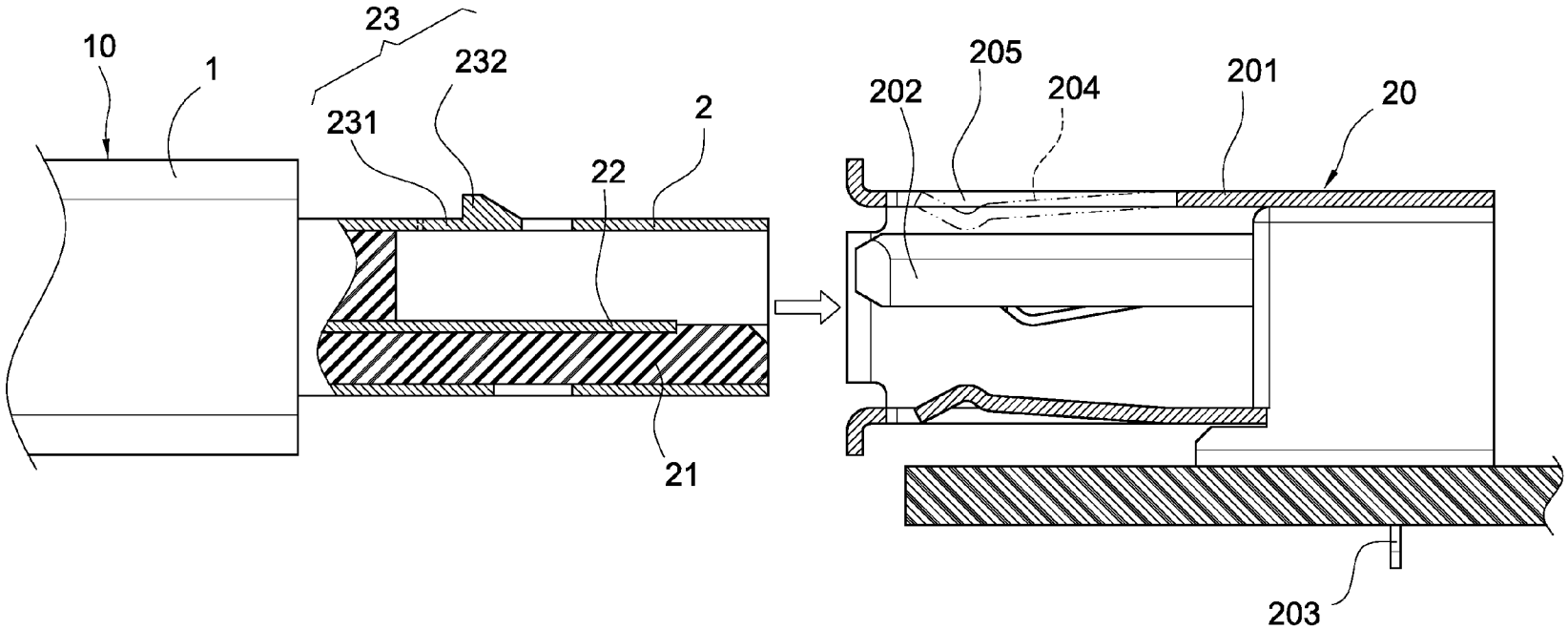
FIG. 3 is a laterally sectional actuation illustration showing an electronic device having USB interface according to the present invention plugged in a USB connector.
Figure 4:
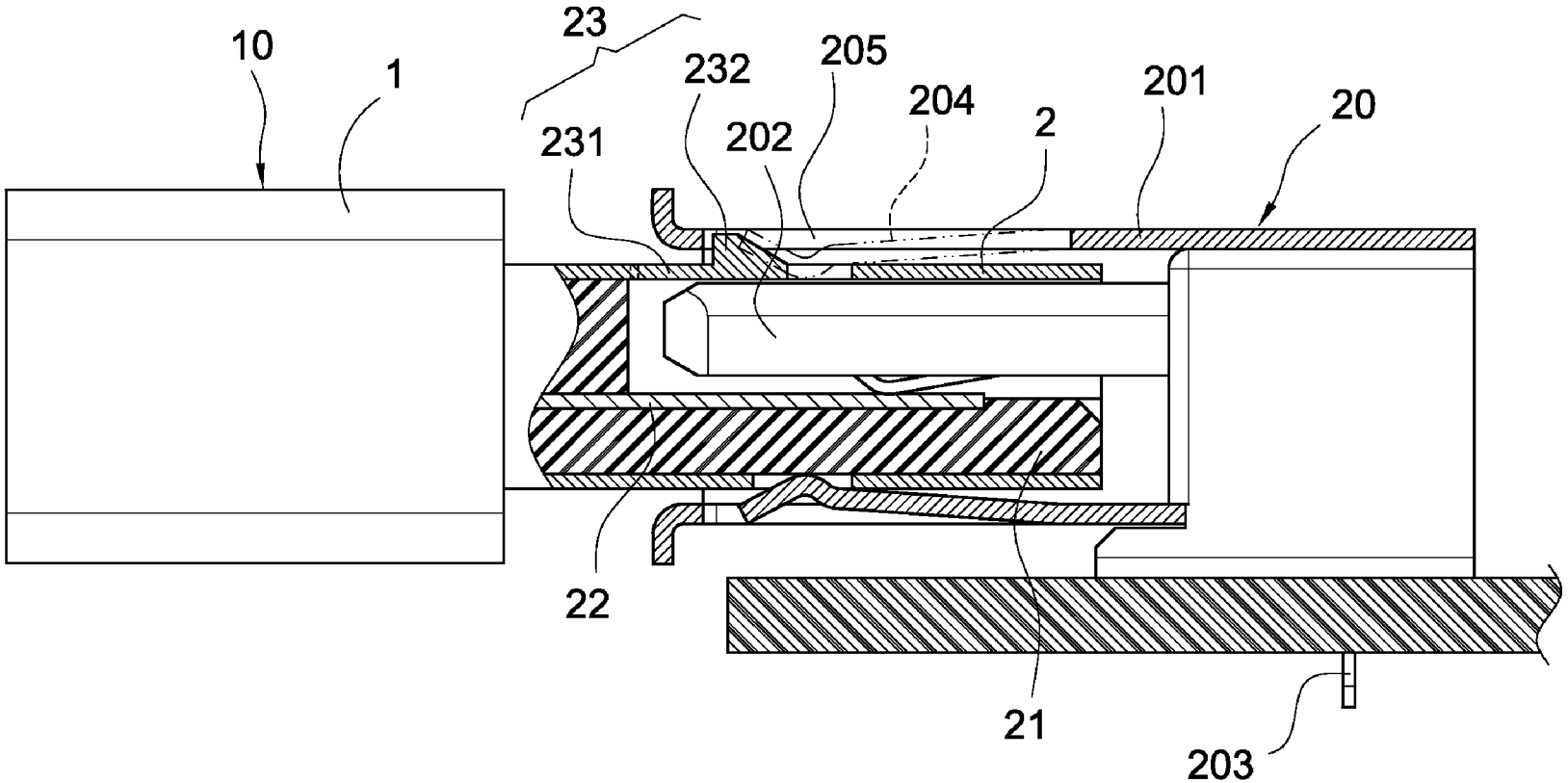
FIG. 4 is a laterally sectional assembled illustration showing an electronic device having USB interface according to the present invention plugged in a USB connector.

Please refer to FIG. 2 through FIG. 4, separately showing an outer perspective, a laterally sectional actuation and a laterally sectional assembled illustration of an electronic device having USB interface according to the present invention. As shown in these figures, after the USB metallic plug 2 of the electronic device is plugged in the connector 201 of the USB connector 20 of an electronic object, the conductive legs 22 on the tongue 21 in the USB metallic plug 2 are electrically connected to the conductive terminals on the tongue 202 in the connector 201. At this time, the barb part 232 of the fastening component 23 on the USB metallic plug 2 is buckled into the groove 205 on the connector 2, where a leaf spring body 204 is originally arranged, such that the USB metallic plug 2 and the connector 201 of the USB connector 20 are formed into a fastening state and unable to be extracted. Therefore, it can prevent the electronic device 10 from being stolen by a thief.

When the electronic device 10 is not used, user can open the shell of the electronic object (not shown in the figures), push the elastic body 231, make the barb part 232 at one side of the elastic body 231 leave the groove 205, and extract the USB metallic plug 2.

Figure 5:
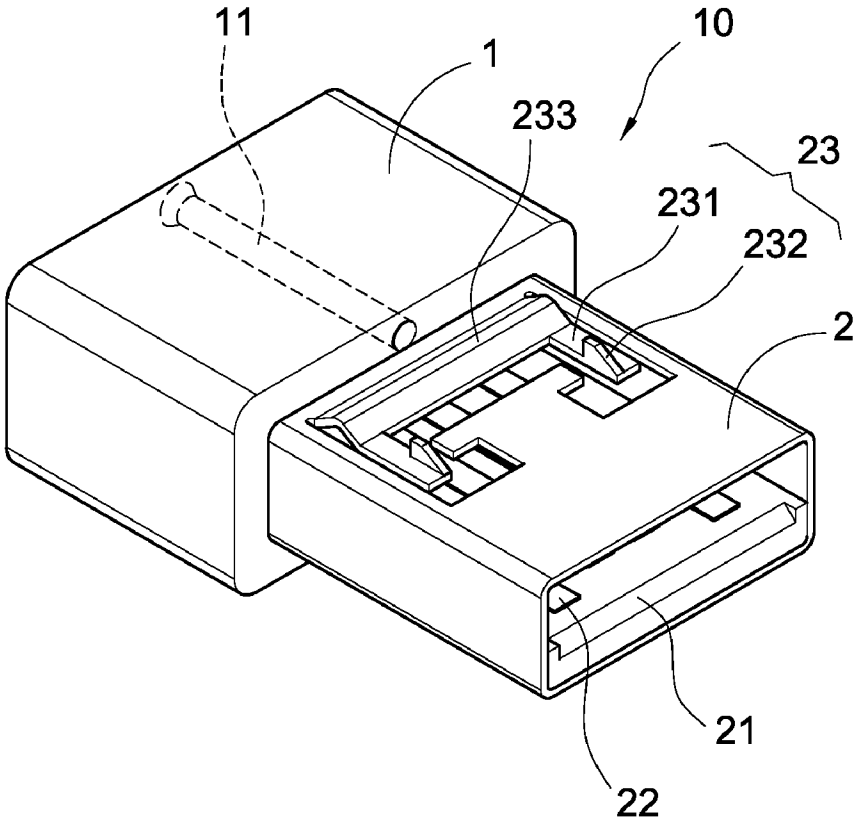
FIG. 5 is an illustration showing an electronic device having USB interface according to another embodiment of the present invention.

Please refer to FIG. 5, showing an illustration of an electronic device having USB interface according to another embodiment of the present invention. As shown in this figure, the electronic device 10 having USB interface capable of extraction proof according to the present invention includes a main body 1, a USB metallic plug 2 and a releasing component 3. The main body 1 can be a transmission line, a USB flash drive, a 3.5" hard disk, a wireless transceiver module, a wireless bridge or a wireless network bridge, etc., on which a hole 11 is arranged and adapted for a tool (not shown in the figures) to be plugged in. One side of the main body 1 has a USB metallic plug 2 arranged thereon. The inside of the USB metallic plug 2 is hollow and arranged a tongue 21, on which a plurality of conductive legs 22 are arranged, one side of each of which is extended into the main body 1 and electrically connected to the circuit (not shown in the figures) and the wire (not shown in the figures) in the main body 1. Additionally, a fastening component 23 having an actuation piece 233 shown as a "<"shape is arranged on a face of the USB metallic plug 2. The actuation piece 233 has two elastic bodies 231 arranged thereon, each side of each of which is arranged a barb part 232.

Figure 6:
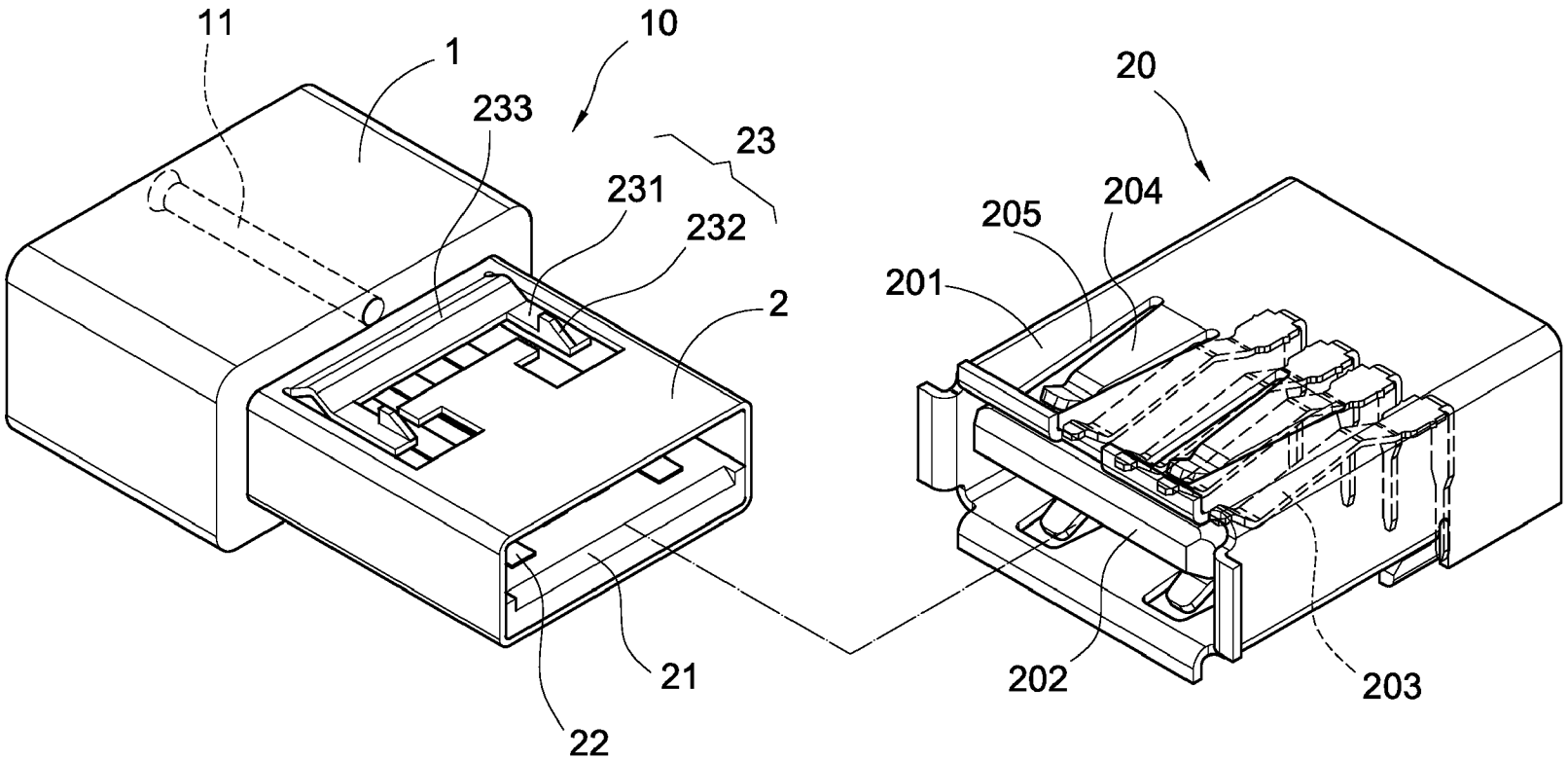
FIG. 6 is an outer perspective illustration showing another electronic device having USB interface according to the present invention plugged in a USB connector.
Figure 7:
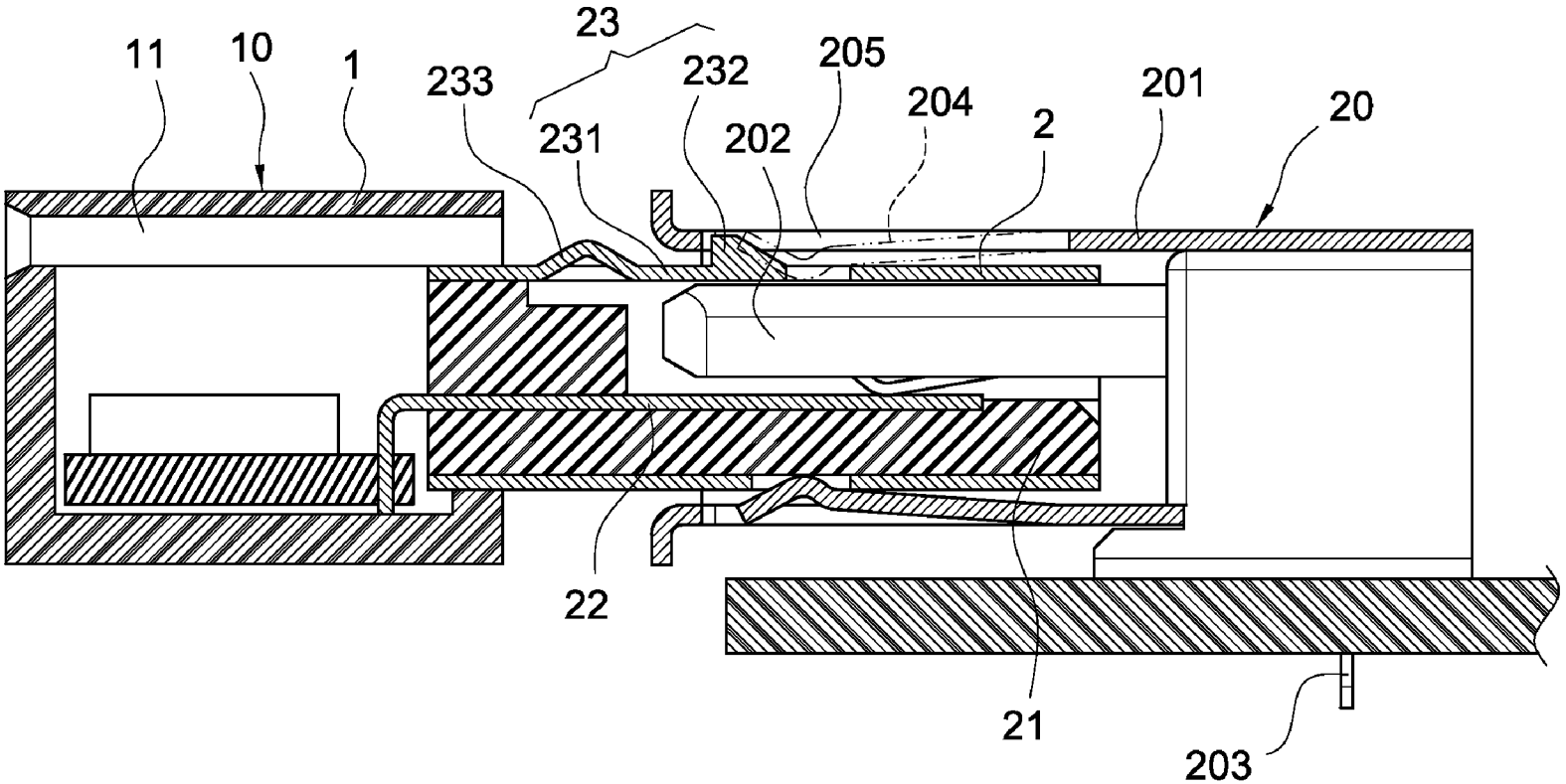
FIG. 7 is a laterally sectional actuation illustration showing another electronic device having USB interface according to the present invention plugged in a USB connector.
Figure 8:
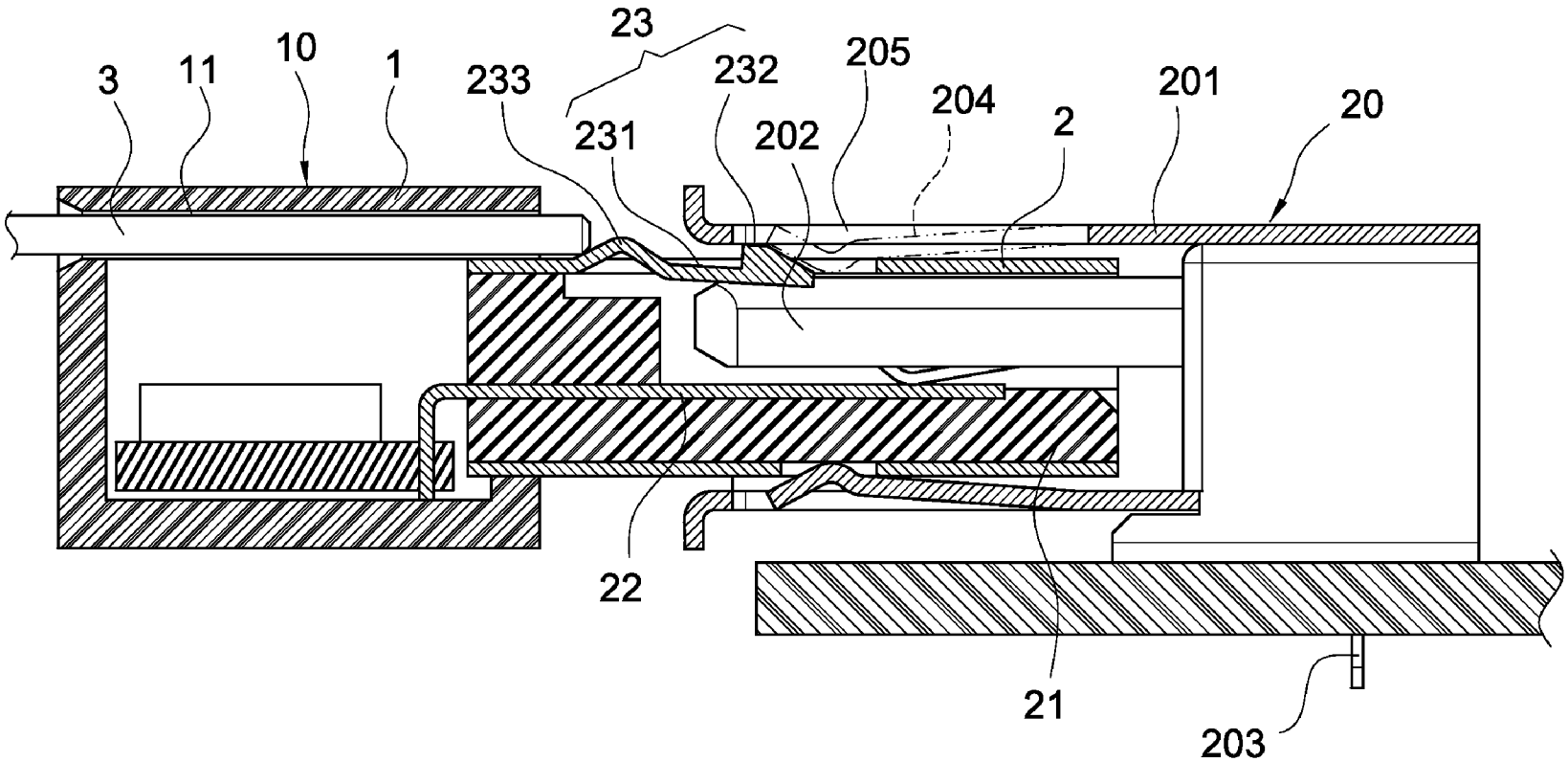
FIG. 8 is a laterally sectional assembled illustration showing another electronic device having USB interface according to the present invention plugged in a USB connector.

Please refer to FIG. 6 through FIG. 8, separately showing an outer perspective, a laterally sectional actuation and a laterally sectional assembled illustration of another electronic device having USB interface according to the present invention. As shown in these figures, after the USB metallic plug 2 of the electronic device is plugged in the connector 201 of the USB connector 20 of an electronic object, the conductive legs 22 on the tongue 21 in the USB metallic plug 2 are electrically connected to the conductive terminals on the tongue 202 in the connector 201. At this time, the barb part 232 of the fastening component 23 on the USB metallic plug 2 is buckled into the groove 205 on the connector 2, where a leaf spring body 204 is originally arranged, such that the USB metallic plug 2 and the connector 201 of the USB connector 20 are formed into a fastening state and unable to be extracted. Therefore, it can prevent the electronic device 10 from being stolen by a thief.

When it intends to release the plugged relationship between the USB metallic plug 2 and the USB connector 20, it is unnecessary to open the shell of the electronic object, instead a tool (rod-shaped object) 3 is inserted into the hole 11 on the main body 1 directly, such that the front of the tool 3 is abutted against the actuation piece 233 of the fastening component 23. The actuation piece 233 actuates the elastic body 231 and makes the barb part 232 at one side of the elastic body 231 leave the groove 205 on the connector 201. After the fastened relationship between the USB metallic plug 2 and the USB connector 20 is released, the USB metallic plug 2 then can be extracted.

Therefore, through the constitution of aforementioned assemblies, an electronic device having USB interface capable of extraction proof according to the present invention is thus obtained.

Summarizing aforementioned description, the electronic device having USB interface capable of extraction proof according to the present invention is an indispensable device for computer and electronic industries indeed, which may positively reach the expected usage objective for solving the drawbacks of the prior arts, and which extremely possesses the innovation and progressiveness to completely fulfill the applying merits of a new type patent, according to which the invention is thereby applied. Please examine the application carefully and grant it as a formal patent for protecting the rights of the inventor.

However, the aforementioned description is only a number of preferable embodiments according to the present invention, not used to limit the patent scope of the invention, so equivalently structural variation made to the contents of the present invention, for example, description and drawings, is all covered by the claims claimed thereinafter.

What is claimed is:

1. An electronic device, having a USB interface capable of extraction proof, plugged in a USB connector arranged to an electronic product and having at least one groove, and including:

a main body, to one side of which a USB metallic plug is connected, and on a face of which at least one fastening component is arranged;

a tool for passing through the main body and engaging the fastening component, wherein the main body is a transmission line, a USB flash drive, a 3.5" hard disk, a wireless transceiver module, a wireless bridge or a wireless network bridge, and wherein an interior of the USB metallic plug is hollow and arranged a tongue, on which a plurality of conductive legs are arranged, and one side of each of which is extended into an interior of the main body to be electrically connected to a circuit or a wire in the main body.

2. The electronic device having the USB interface according to claim 1, wherein the fastening component has two elastic bodies, and at each side of each of which a barb part is arranged.

3. An electronic device, having a USB interface capable of extraction proof, plugged in a USB connector arranged to an electronic product and having at least one groove, and including:

a main body, on which a hole is arranged, and to one side of which a USB metallic plug is connected, on a face of which is at least one fastening component is arranged, which is adapted for being fastened in a groove;

a tool for insertion through the main body, wherein the tool provides a means for releasing the fastening state between the fastening component and the groove when the tool is inserted through the main body and extends out of the main body and is abutted against the fastening component, wherein the main body is a transmission line, a USB flash drive, a 3.5" hard disk, a wireless transceiver module, a wireless bridge or a wireless network bridge, and wherein an interior of the USB metallic plug is hollow and arranged a tongue, on which a plurality of conductive legs are arranged, and one side of each of which is extended into an interior of the main body to be electrically connected to a circuit or a wire in the main body.

4. The electronic device having the USB interface according to claim 3, wherein the fastening component is arranged an actuation piece shown as a V-shape and having two elastic bodies, and at each side of each of which a barb part is arranged, wherein when the tool is abutted against the fastening component it abuts against the actuation piece thereby actuating the elastic body and making the barb leave the groove.

5. The electronic device having the USB interface according to claim 3, wherein the tool is a rod-like object.

* * * * *